US012053142B2

(12) United States Patent
Park et al.

(10) Patent No.: US 12,053,142 B2
(45) Date of Patent: Aug. 6, 2024

(54) MOBILE ROBOT OPERATION CONTROL METHOD FOR SAFETY MANAGEMENT OF CLEANING MODULE AND APPARATUS THEREFOR

(71) Applicants: YUJIN ROBOT CO., LTD., Incheon (KR); Miele & Cie. KG, Gütersloh (DE)

(72) Inventors: Seong Ju Park, Incheon (KR); Chang Soo Kim, Incheon (KR); Byung Kwon Moon, Incheon (KR); Nu Rim Han, Incheon (KR)

(73) Assignees: YUJIN ROBOT CO., LTD., Incheon (KR); Miele & Cie. KG, Gütersloh (DE)

( * ) Notice: Subject to any disclaimer, the term of this patent is extended or adjusted under 35 U.S.C. 154(b) by 314 days.

(21) Appl. No.: 17/535,917

(22) Filed: Nov. 26, 2021

(65) Prior Publication Data

US 2022/0167810 A1 Jun. 2, 2022

(30) Foreign Application Priority Data

Nov. 27, 2020 (KR) ..... 10-2020-0162460
Nov. 17, 2021 (KR) ..... 10-2021-0158831

(51) Int. Cl.
*A47L 9/28* (2006.01)
*A47L 9/04* (2006.01)

(52) U.S. Cl.
CPC ..... *A47L 9/2831* (2013.01); *A47L 9/2852* (2013.01); *A47L 9/0411* (2013.01); *A47L 2201/04* (2013.01)

(58) Field of Classification Search
CPC .... A47L 9/2831; A47L 9/2852; A47L 9/0411; A47L 2201/04; A47L 2201/00
See application file for complete search history.

(56) References Cited

U.S. PATENT DOCUMENTS 9,993,129 B2 6/2018 Santini
11,291,345 B2 * 4/2022 Davila ..... A47L 11/302
(Continued)

FOREIGN PATENT DOCUMENTS

KR 10-1994-0010967 A 6/1994
KR 10-1324166 B1 11/2013
(Continued)

OTHER PUBLICATIONS

Request for the Submission of an Opinion for 10-2021-0158831 by Korean Intellectual Property Office dated Jul. 1, 2023.

*Primary Examiner* — Kira Nguyen
(74) *Attorney, Agent, or Firm* — BROADVIEW IP LAW, PC

(57) ABSTRACT

Disclosed are a mobile robot operation control method for safety management of a cleaning module and an apparatus therefor. The mobile robot operation control method for safety management according to an exemplary embodiment of the present disclosure includes a current measuring step of measuring a current value by sensing a current for a motor which is connected to a cleaning module to be driven; a cleaning module safety management step of determining a state of the cleaning module based on the measured current value and determining a safety management control mode based on the determination result; and an operation control step of controlling an operation of a mobile robot based on the safety management control mode.

12 Claims, 11 Drawing Sheets

(56) References Cited

U.S. PATENT DOCUMENTS

| | | | | |
|---|---|---|---|---|
| 2013/0025085 | A1* | 1/2013 | Kim | A47L 9/2889 700/258 |
| 2016/0235270 | A1* | 8/2016 | Santini | A47L 11/4041 |
| 2021/0034061 | A1* | 2/2021 | Yun | A47L 11/4011 |
| 2021/0177226 | A1* | 6/2021 | Burns | A47L 9/2805 |

FOREIGN PATENT DOCUMENTS

| | | | |
|---|---|---|---|
| KR | 10-2016-0107663 | A | 9/2016 |
| KR | 10-2018-0092433 | A | 8/2018 |

* cited by examiner

MOBILE ROBOT OPERATION CONTROL METHOD FOR SAFETY MANAGEMENT OF CLEANING MODULE AND APPARATUS THEREFOR

CROSS-REFERENCE TO RELATED APPLICATIONS

This application claims priority to and the benefit of Korean Patent Application No. 10-2020-0162460 filed in the Korean Intellectual Property Office on Nov. 27, 2020 and Korean Patent Application No. 10-2021-0158831 filed in the Korean Intellectual Property Office on Nov. 17, 2021, the entire contents of which are incorporated herein by reference.

BACKGROUND

Field

The present disclosure relates to an operation control method of a mobile robot which safely manages an overload and an abnormal operation of a cleaning module such as a main brush and an apparatus therefor.

Description of the Related Art

The contents described in this section merely provide background information on the exemplary embodiment of the present disclosure, but do not constitute the related art.

As a floor cleaning method of a mobile robot, most of mobile robots include a side brush which is an auxiliary cleaning module rotating to the inside of the robot in a left/right diagonal directions in front of the mobile robot, a main brush as a main cleaning module at a lower center portion of the robot, and a suction module which operates in association therewith.

The side brush which is an auxiliary cleaning module sweeps away dust which may be located outside the robot main suction module located at the bottom of the mobile robot and moves the dust to the main cleaning module and the collected dust finally moves to a dust bin by the rotating main brush which is the main cleaning module and the suction module.

In the mobile robot, a load may be applied to a cleaning module such as a main brush according to a floor environment. For example, the mobile robot operates on a hard floor without causing any problems, but in the case of a deep carpet, the mobile robot may operate with a large load on the main brush. Accordingly, an energy of the motor which rotates the main brush is consumed a lot, a current is increased, and an internal temperature of the motor rapidly rises.

Even though there is no problem in a floor environment in which carpets are intermittently located, in a floor environment in which many carpets are located, the loads are continuously applied to the motor so that many damages may be caused in a motor, a gear, or a circuit device of the cleaning module. Further, when the mobile robot moves along a texture of the piles on the carpet, a low load is applied, but when the mobile robot moves in a reverse direction of the texture, a high load is applied. In this case, only when the mobile robots moves along the reverse direction, the cleaning module may be damaged. Therefore, safety management for the overload or the abnormal operation of the cleaning module during the cleaning operation of the mobile robot is necessary.

SUMMARY

A main object of the present disclosure is to provide a mobile robot operation control method for safety management of a cleaning module which determines a state of a cleaning module based on a current value measured from a motor of the cleaning module, determines a safety management control mode based on the determination result, and controls an operation of the mobile robot based on the safety management control mode and an apparatus therefor.

According to an aspect of the present disclosure, in order to achieve the above-described objects, a mobile robot operation control method for safety management includes a current measuring step of measuring a current value by sensing a current for a motor which is connected to a cleaning module to be driven; a cleaning module safety management step of determining a state of the cleaning module based on the measured current value and determining a safety management control mode based on the determination result; and an operation control step of controlling an operation of a mobile robot based on the safety management control mode.

Further, according to another aspect of the present disclosure, in order to achieve the above-described objects, a mobile robot operation control apparatus for safety management includes a current measuring unit which measures a current value by sensing a current for a motor which is connected to a cleaning module to be driven; a cleaning module safety management unit which determines a state of the cleaning module based on the measured current value and determines a safety management control mode based on the determination result; and an operation control unit which controls an operation of a mobile robot based on the safety management control mode.

Further, according to another aspect of the present disclosure, in order to achieve the above-described objects, a mobile robot includes at least two main wheels; a movement motor which generates a driving force to rotate the main wheels; a main brush to which at least one blade is coupled; a main brush motor which rotates the main brush; and a mobile robot operation control apparatus which measures a current value by sensing a current from the main brush motor, determines a state of the cleaning module based on the measured current value and determines a safety management control mode based on the determination result, and controls an operation of a mobile robot based on the safety management control mode.

As described above, according to the present disclosure, the overload of the cleaning motor and the main brush motor of a mobile robot which operates in various environments is prevented to suppress damage of the cleaning motor or the shortened lifespan due to overcurrent or increased internal temperature which may occur.

Further, according to the present disclosure, a state in which a low voltage is applied to a motor or an abnormal operation due to the jamming, rather than the load due to the carpet, even in a normal state are sensed to immediately notify a user of an error notification about a normal operation and an erroneous situation of the mobile robot and internal modules.

DETAILED DESCRIPTION OF THE EMBODIMENT

Hereinafter, exemplary embodiments of the present disclosure will be described in detail with reference to the accompanying drawings. In the description of the present disclosure, if it is considered that the specific description of related known configuration or function may cloud the gist of the present disclosure, the detailed description will be omitted. Further, hereinafter, exemplary embodiments of the present disclosure will be described. However, it should be understood that the technical spirit of the invention is not restricted or limited to the specific embodiments, but may be changed or modified in various ways by those skilled in the art to be carried out. Hereinafter, a mobile robot operation control method for safe management of a cleaning module proposed by the present disclosure and an apparatus therefor will be described in detail with reference to drawings.

The mobile robot of the present disclosure is desirably a cleaning robot, but is not necessarily limited thereto, and may be robots in various fields to which the floor environment sensing is applicable. For example, the mobile robot may be industrial robots including a household cleaning robot, a public building cleaning robot, a logistics robot, and a service robot.

Figure 1:
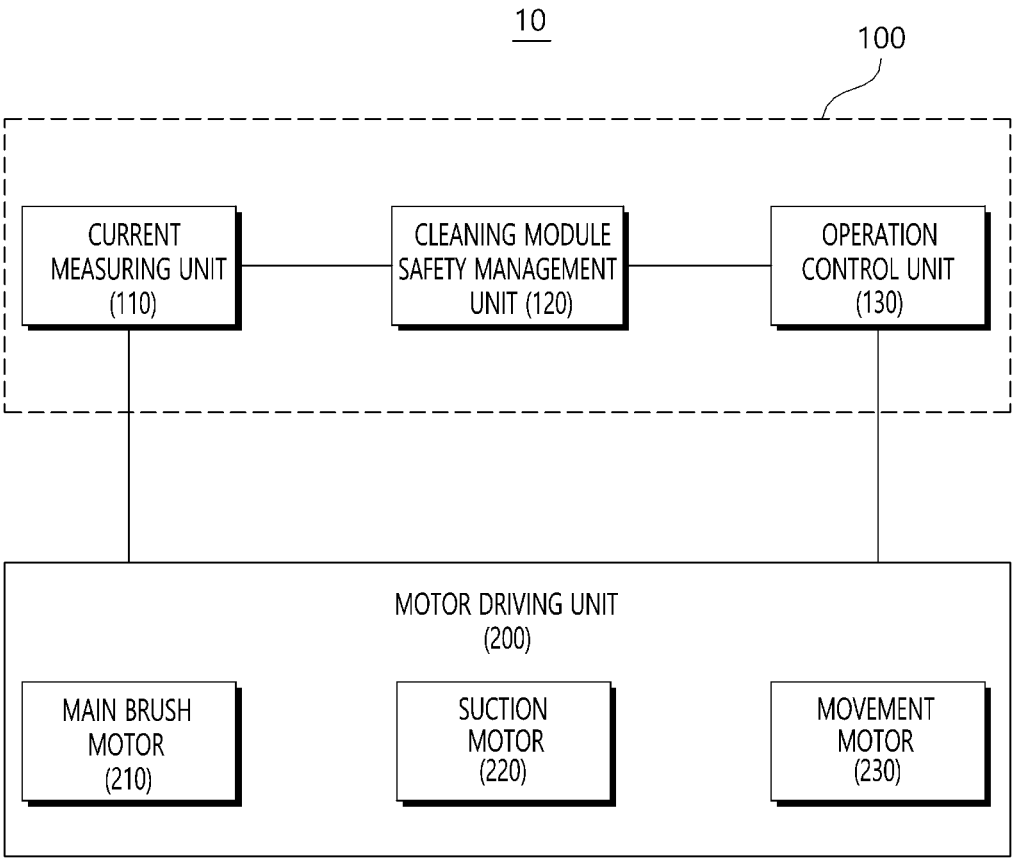
FIG. 1 is a block diagram schematically illustrating a mobile robot including a mobile robot operation control apparatus for safety management of a cleaning module according to an exemplary embodiment of the present disclosure.

FIG. 1 is a block diagram schematically illustrating a mobile robot including a mobile robot operation control apparatus for safety management of a cleaning module according to an exemplary embodiment of the present disclosure.

A mobile robot 10 according to the exemplary embodiment includes a mobile robot operation control apparatus 100 and a motor driving unit 200. The mobile robot 10 of FIG. 1 is an example so that all blocks illustrated in FIG. 1 are not essential components and in the other exemplary embodiment, some blocks included in the mobile robot 10 may be added, modified, or omitted.

The mobile robot 10 performs an operation of removing dust or foreign materials on the floor while moving a cleaning area along a predetermined cleaning route.

The mobile robot 10 according to the exemplary embodiment determines a state of a cleaning module based on a current value measured from a motor of the cleaning module during the cleaning operation, determines a safety management control mode based on the determination result, and controls the cleaning operation based on the safety management control mode.

The mobile robot 10 illustrated in FIG. 1 is provided to explain a control operation of an operation of a mobile robot to perform the safety management of the cleaning module so that only some components for sensing a state related to the cleaning module and controlling the operation of the mobile robot may be described. In other words, in the mobile robot 10 illustrated in FIG. 1, components which are generally included in the mobile robot, such as auxiliary wheels, main brushes, and side brushes, may be omitted.

The mobile robot operation control apparatus 100 determines a state of a cleaning module based on a current value measured from a motor of the cleaning module, determines a safety management control mode based on the determination result, and controls the operation of the mobile robot 10 based on the safety management control mode. The mobile robot operation control apparatus 100 according to the exemplary embodiment includes a current measuring unit 110, a cleaning module safety management unit 120, and an operation control unit 130. Hereinafter, components included in the mobile robot operation control apparatus 100 will be described.

The current measuring unit 110 performs an operation of measuring a current value for a motor which is connected to a cleaning module equipped in the mobile robot to be driven.

The current measuring unit 110 according to the exemplary embodiment acquires a current value according to a rotation operation of a main brush from a main brush motor 210 connected to the main brush of the mobile robot 10, but is not limited thereto. For example, the current measuring unit 110 may acquire a current value measured from all or some of motors of a main brush motor 210, a suction motor 220 and a movement motor 230.

In the meantime, even though it is described that the current measuring unit 110 measures a current value by seining a current from a motor which is connected to the cleaning module equipped in the mobile robot 10 to be driven, it is not necessarily limited thereto so that a voltage may be measured by sensing a voltage from the motor.

The cleaning module safety management unit 120 performs an operation of determining a state of the cleaning module based on a current value measured in the motor of the cleaning module and determining a safety management control mode based on the determination result.

The cleaning module safety management unit 120 compares the current value measured from the motor of the cleaning module with a predetermined reference current value to determine a state of the current of the motor. Specifically, the cleaning module safety management unit 120 determines the state of the current of the motor by comparing the measured current value with at least one reference current value of a first reference current value, a second reference current value, and an average current value.

The first reference current value refers to a maximum current value in a safety reference current value range set in advance for the motor and the second reference current value refers to a minimum current value in a safety reference current value range set in advance for the motor. Further, the average current value refers to an average or a standard deviation of current values measured for a predetermined time.

Thereafter, the cleaning module safety management unit 120 determines a safety state of the cleaning module based on the determination result of the current state. Specifically, the cleaning module safety management unit 120 determines at least one safety state among an overload state, an abnormal stop state, and an abnormal jamming state, based on the current state of the motor.

Thereafter, the cleaning module safety management unit 120 determines a safety management control mode corresponding to a safety state determining result of the cleaning module. Specifically, the cleaning module safety management unit 120 determines a safety management control mode to perform at least one control operation of an operation of controlling an applied voltage of the motor and an operation of notifying an error message for an abnormal operation, based on the safety state determining result.

In the overload state, the cleaning module safety management unit 120 determines a first safety management control mode to control a voltage applied to the motor to a minimum voltage. Further, in an abnormal stop state, the cleaning module safety management unit 120 determines a second safety management control mode to control the motor to stop applying a voltage and notify the error message for the abnormal stop state. Further, in an abnormal jamming state, the cleaning module safety management unit 120 determines a third safety management control mode to control a voltage applied to the motor to a minimum voltage and notify the error message for the abnormal jamming state.

Hereinafter, the safety management operation for the overload state in the cleaning module safety management unit 120 will be described.

When a measured current value is equal to higher than the first reference current value, the cleaning module safety management unit 120 determines the safety state to a motor overloaded state and determines the first safety management control mode corresponding to the overload state. Here, the first safety management control mode refers to a control mode set to control a voltage applied to the motor to the minimum voltage.

Hereinafter, the safety management operation for the abnormal stop state in the cleaning module safety management unit 120 will be described.

When a measured current value is lower than the second reference current value, the cleaning module safety management unit 120 determines the safety state to a motor abnormally stopped state and determines the second safety management control mode corresponding to the abnormal stop state. Here, the second safety management control mode refers to a control mode set to control to stop applying a voltage to the motor and notify an error message for the abnormal stop state.

The cleaning module safety management unit 120 determines a safety state for the abnormal stop state in different manners depending on whether an encoder is connected to the motor.

When the encoder is connected to the motor, the cleaning module safety management unit 120 compares a rotation speed of the motor with an input voltage measured by the encoder to determine the safety state of the abnormal stop state.

When the encoder is not connected to the motor, the cleaning module safety management unit 120 determines the safety state for the abnormal stop state based on whether to satisfy a predetermined error detection condition. The predetermined error detection condition may be represented by Table 1.

TABLE 1

```
if ( input _motor_vol == MINUMUM_INPUT_VOL )
{
  if  (  main_brush_motor_cur  >
MAIN_BRUSH_MOTOR_OVERCURRENT_THRESHOLD_CUR )
  {
    if ( ++count >= ERROR_TIME )
    {
      MAIN_BRUSH_ERROR = true;
    }
  }
}
```

Referring to Table 1, when the encoder is not connected to the motor, if the voltage applied to the motor corresponds to a predetermined minimum applied voltage and a state in which a measured current of the current exceeds a predetermined overcurrent reference value is maintained for a predetermined time, the cleaning module safety management unit 120 may determine that the safety state is an abnormal stop state.

Hereinafter, the safety management operation for the abnormal jamming state in the cleaning module safety management unit 120 will be described.

When the measured current value is between the first reference current value and the second reference current value and a current state which is equal to or higher than an average current value measured for a predetermined time, the cleaning module safety management unit 120 determines that the safety state is a motor's abnormally jammed state and determines a third safety management control mode corresponding to the abnormal jamming state. Specifically, the cleaning module safety management unit 120 calculates a standard deviation of the current values measured for a predetermined time and when the standard deviation is equal to or higher than the average current value, determines that the safety state is a motor's abnormally jammed state. Here, the third safety management control mode refers to a control mode to control a voltage applied to the motor to a minimum voltage and notify an error message for the abnormal jamming state.

The operation control unit 130 controls the operation of the mobile robot based on the safety management control mode determined in the cleaning module safety management unit 120.

When the safety management control mode is determined as a first safety management control mode, the operation control unit 130 controls the operation of the mobile robot 10 to control a voltage applied to the motor to a minimum voltage based on the first safety management control mode corresponding to the overload state.

When the safety management control mode is determined as a second safety management control mode, the operation control unit 130 controls an operation of the mobile robot 10 to stop applying the voltage to the motor and notify the error message for the abnormal stop state based on the second safety management control mode corresponding to the abnormal stop state.

When the safety management control mode is determined as a third safety management control mode, the operation control unit 130 controls an operation of the mobile robot 10 to control the voltage applied to the motor to a minimum voltage and notify the error message for the abnormal jamming state based on the third safety management control mode corresponding to the abnormal jamming state.

The motor driving unit 220 refers to a module including at least one motor equipped in the mobile robot 10. The motor driving unit 200 may include various types of motors related to the cleaning operation of the mobile robot 10.

The motor driving unit 200 interworks with the mobile robot operation control apparatus 100 and provides operation information about at least one motor included in the motor driving unit 200 to the mobile robot operation control apparatus 100.

The operation information for each motor may include motor-on/off information, a current value for driving the motor, a motor speed of revolution (a speed of revolution per second).

The motor driving unit 200 according to the exemplary embodiment may include a main brush motor 210, a suction motor 220, and a movement motor 230. Hereinafter, components included in the motor driving unit 200 will be described.

The main brush motor 210 is a motor for rotating the main brush 710 which rotates while being in contact with the floor to effectively perform the cleaning operation of sucking dust or foreign materials of the floor and generates a driving force to rotate the main brush 710.

The main brush connected to the main brush motor 210 is implemented such that a blade formed of an elastic material or a bristle material is coupled to a cylindrical pipe. The main brush comes into contact with the floor or the foreign materials while being rotated by the main brush motor 210, the shape of the coupled blade is deformed and then is restored to a shape before being deformed when it is separated from the floor or the foreign materials. Here, the blade coupled to the main brush may be a rubber material having a predetermined hardness, but is not necessarily limited thereto so that various materials may be applied as long as the shape of the blade can be deformed and restored.

The main brush motor 210 may transmit a current value measured for the driving force which rotates the main brush to the mobile robot operation control apparatus 100. Here, in the main brush motor 210, the measured current value may vary by the resistance which is generated when the rotating main brush comes into contact with the floor.

The main brush motor 210 adjusts a driving force to rotate the main brush 710 for safety management of the cleaning module according to an operation control signal received from the mobile robot operation control apparatus 100.

The suction motor 220 is connected to a suction port of the mobile robot 10 to generate a suction force to suck the dust or foreign materials.

The suction motor 220 is driven while the mobile robot 10 moves in the cleaning area according to the cleaning route set by the processor (not shown) of the mobile robot 10 so that dust or foreign materials on the floor are sucked into the suction port.

Further, the suction motor 220 adjusts a suction force to suck the dust or foreign materials for safety management of the cleaning module according to an operation control signal received from the mobile robot operation control apparatus 100.

The movement motor 230 is a motor for rotating main wheels 740*a* and 540*b* of the mobile robot 10 and is connected to the main wheels 740*a* and 540*b* and generates a driving force to rotate the main wheels 740*a* and 540*b*.

The movement motor 230 rotates the main wheels 740*a* and 540*b* to move the mobile robot 10 along the cleaning route set by the processor (not illustrated) of the mobile robot 10.

Further, the movement motor 230 adjusts a driving force to rotate the main wheels 740*a* and 540*b* for safety management of the cleaning module according to an operation control signal received from the mobile robot operation control apparatus 100.

Even though in FIG. 1, it is described that the motor driving unit 200 includes only the main brush motor 210, the suction motor 220, and the movement motor 230, the present disclosure is not necessarily limited thereto so that various types of motors related to the cleaning operation of the mobile robot 10, such as a side brush motor, may be further included.

Figure 2:
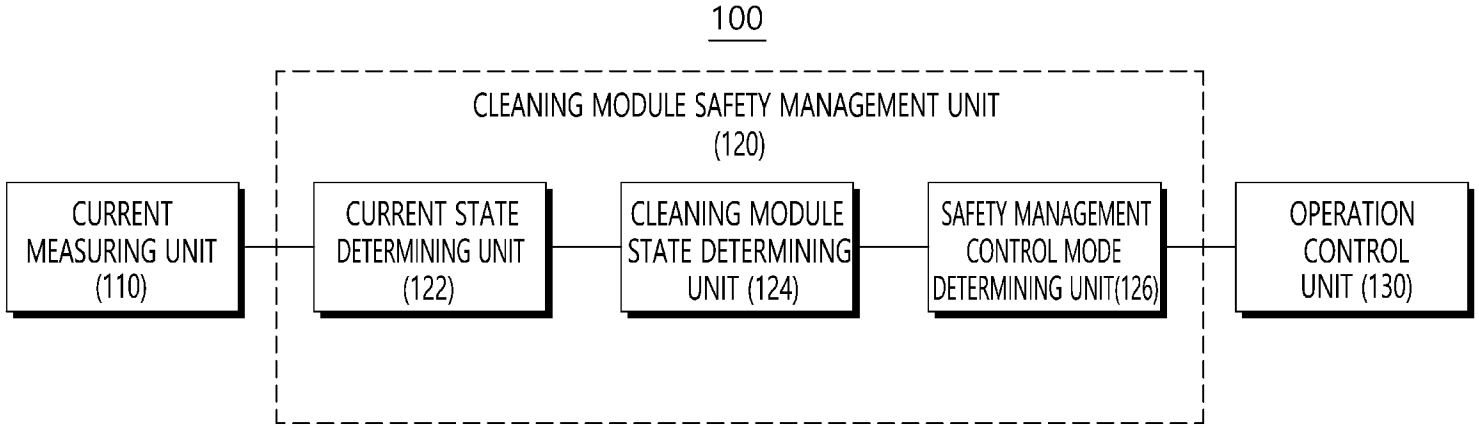
FIG. 2 is a block diagram schematically illustrating a cleaning module safety management unit of a mobile robot operation control apparatus according to an exemplary embodiment of the present disclosure.

FIG. 2 is a block diagram schematically illustrating a cleaning module safety management unit of a mobile robot operation control apparatus according to an exemplary embodiment of the present disclosure.

The cleaning module safety management unit 120 of the mobile robot operation control apparatus 100 according to the exemplary embodiment determines a state of the cleaning module based on a current value measured from the motor of the cleaning module and determines a safety management control mode based on the determination result.

The cleaning module safety management unit 120 according to the exemplary embodiment includes a current state determining unit 122, a cleaning module state determining unit 124, and a safety management control mode determining unit 126. Hereinafter, the operation of performing the safety management of the cleaning module will be described with reference to components included in the cleaning module safety management unit 120.

The current state determining unit 122 compares the current value measured from the motor of the cleaning module with a predetermined reference current value to determine a state of the current of the motor. Specifically, the current state determining unit 122 determines the state of the current of the motor by comparing the measured current value with at least one reference current value of a first reference current value, a second reference current value, and an average current value. The first reference current value refers to a maximum current value in a safety reference current value range set in advance for the motor and the second reference current value refers to a minimum current value in a safety reference current value range set in advance for the motor. Further, the average current value refers to an average or a standard deviation of current values measured for a predetermined time.

The cleaning module state determining unit 124 determines a safety state of the cleaning module based on the determination result of the current state. Specifically, the cleaning module state determining unit 124 determines at least one safety state among an overload state, an abnormal stop state, and an abnormal jamming state, based on the current state of the motor.

Thereafter, the safety management control mode determining unit 126 determines a safety management control mode corresponding to a safety state determining result of the cleaning module. Specifically, the safety management control mode determining unit 126 determines a safety management control mode to perform at least one control operation of an operation of controlling an applied voltage of the motor and an operation of notifying an error message for an abnormal operation, based on the safety state determining result.

In the overload state, the cleaning module safety management unit 120 determines a first safety management control mode to control a voltage applied to the motor to a minimum voltage. Further, in an abnormal stop state, the cleaning module safety management unit 120 determines a second safety management control mode to control the motor to stop applying a voltage and notify the error message for the abnormal stop state. Further, in an abnormal jamming state, the cleaning module safety management unit 120 determines a third safety management control mode to control a voltage applied to the motor to a minimum voltage and notify the error message for the abnormal jamming state.

FIGS. 3 to 6 are flowcharts for explaining a mobile robot operation control method for safety management of a cleaning module according to an exemplary embodiment of the present disclosure.

Figure 3:
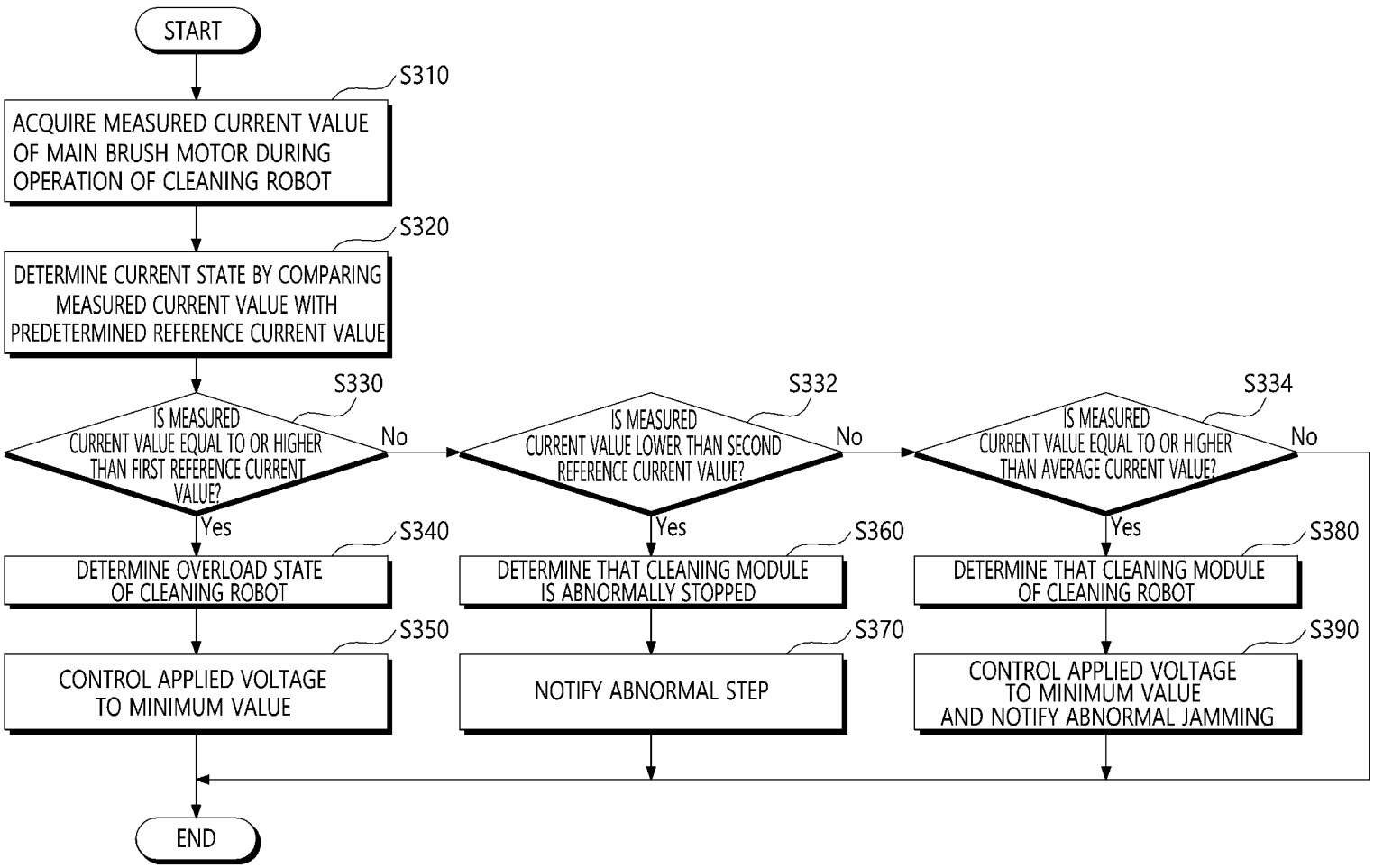
FIGS. 3 to 6 are flowcharts for explaining a mobile robot operation control method for safety management of a cleaning module according to an exemplary embodiment of the present disclosure.

FIG. 3 illustrates an overall mobile robot operation control operation for safety management of a cleaning module.

The mobile robot operation control apparatus 100 acquires a measured current value of a main brush motor during an operation of the mobile robot in step S310.

The mobile robot operation control apparatus 100 compares the measured current value and a predetermined reference current value to determine a current state in step S320.

When the measured current value is equal to or higher than the first reference current value in step S330, the mobile robot operation control apparatus 100 determines that the cleaning module is in an overload state in step s340.

The mobile robot operation control apparatus 100 controls a voltage applied to the motor to a minimum value, based on the first safety management control mode corresponding to the overload state.

In the meantime, when the measured current value is lower than the second reference current value in step S332, the mobile robot operation control apparatus 100 determines that the cleaning module is in an abnormal stop state in step s360.

The mobile robot operation control apparatus 100 controls to stop applying a voltage to the motor based on the second safety management control mode corresponding to the abnormal stop state and notify an error message for the abnormal stop state in step S370.

In the meantime, when the measured current value is equal to or higher than an average current value in step S334, the mobile robot operation control apparatus 100 determines that the cleaning module is in an abnormal jamming state in step s380.

The mobile robot operation control apparatus 100 controls a voltage applied to the motor to a minimum voltage based on the third safety management control mode corresponding to the abnormal jamming state and notify an error message for the abnormal jamming state in step S390.

Figure 4:
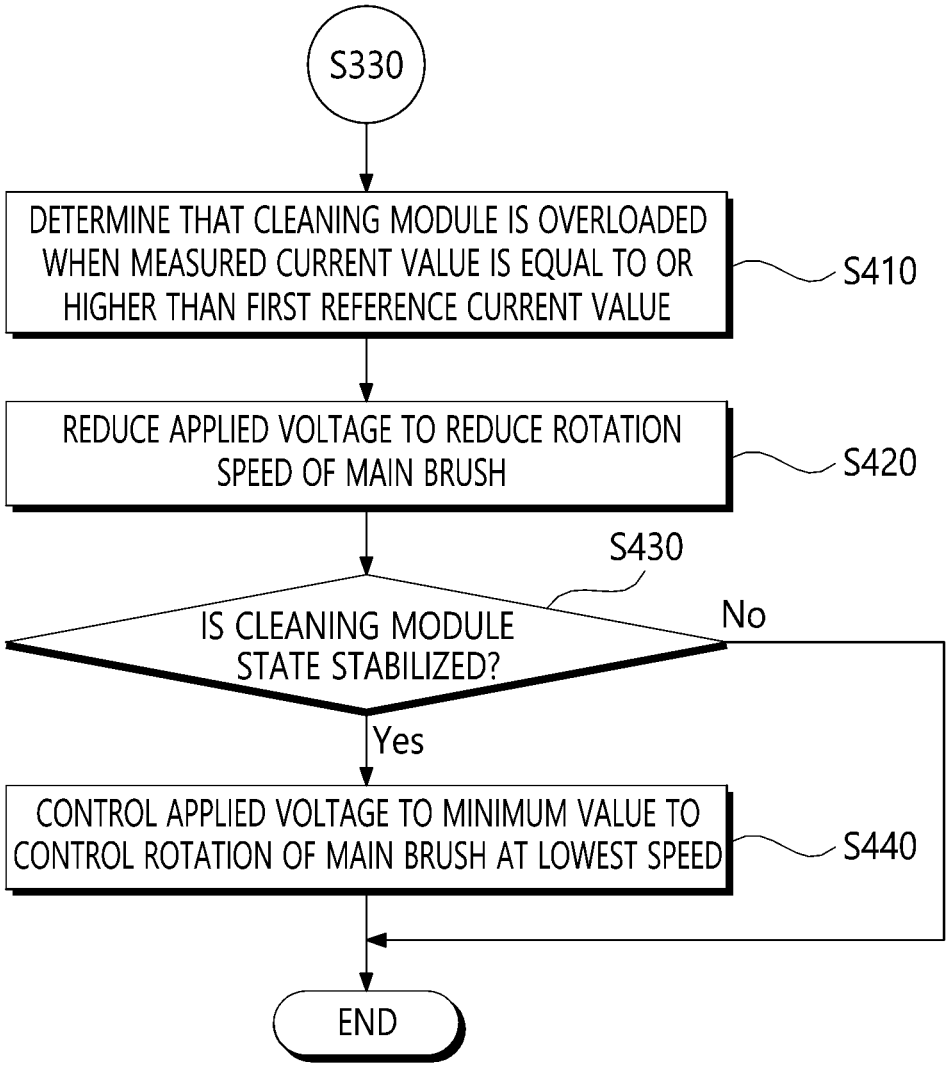

FIG. 4 illustrates a mobile robot operation control operation for safety management of a cleaning module in an overload state.

When the measured current value is equal to or higher than the first reference current value, the mobile robot operation control apparatus 100 determined that the cleaning module is in an overload state in step s410.

The mobile robot operation control apparatus 100 reduces a voltage applied to the motor to a predetermined value to reduce a rotation speed of the main brush in step s420.

The mobile robot operation control apparatus 100 determines whether a state of the cleaning module is stabilized in step S430.

When the state of the cleaning module is not stabilized, the mobile robot operation control apparatus 100 controls the applied voltage to a minimum value to control the rotation of the main brush at a lowest speed in step S440.

In contrast, the state of the cleaning module is stabilized, the mobile robot operation control apparatus 100 normally performs the cleaning operation.

Figure 5:
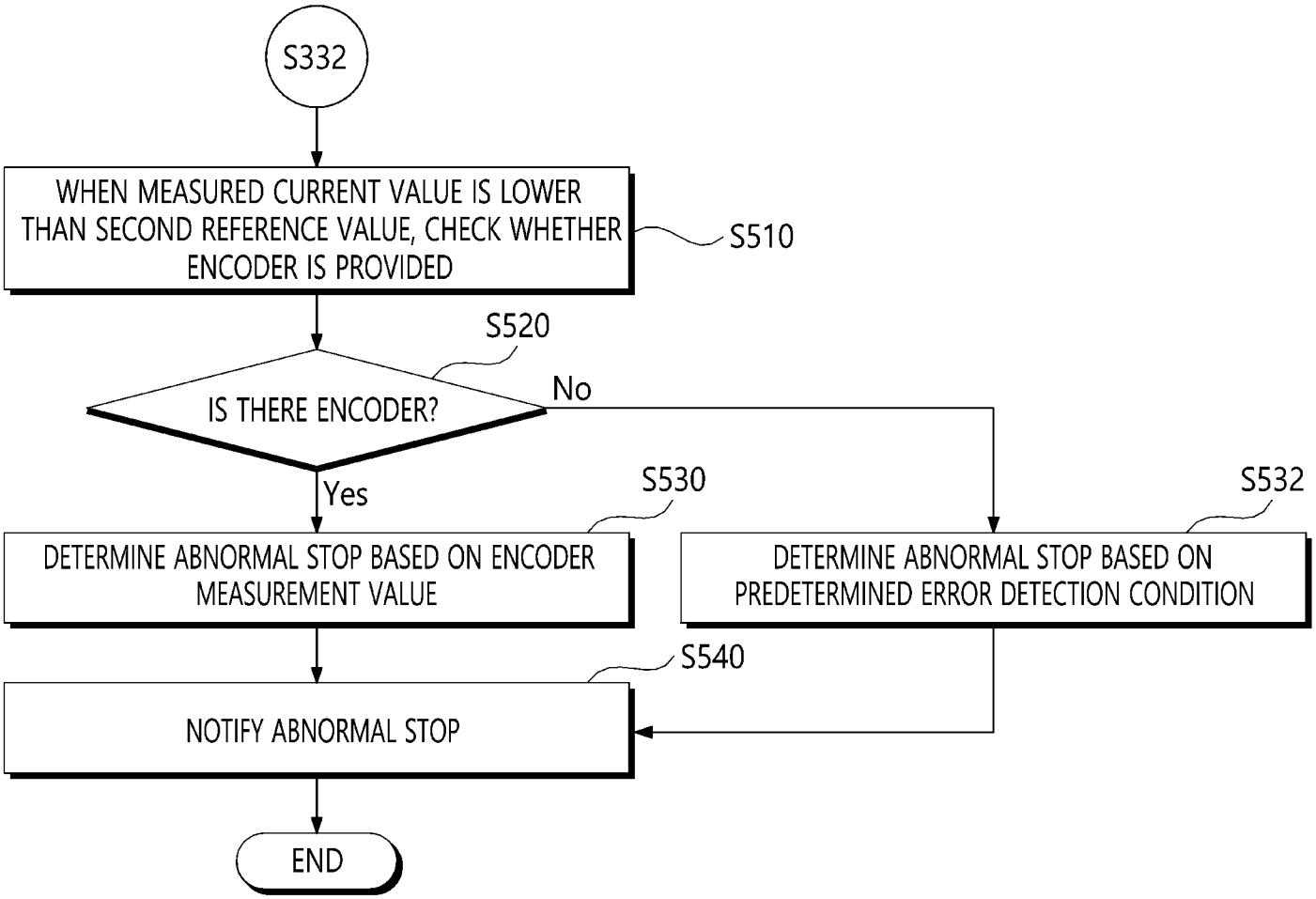

FIG. 5 illustrates a mobile robot operation control operation for safety management of a cleaning module in an abnormal stop state.

When the measured current value is lower than the second reference current value, the mobile robot operation control apparatus 100 checks whether an encode is provided in step S510.

When there is an encoder connected to the motor in step S520, the mobile robot operation control apparatus 100 determines an abnormal stop state based on an encoder measurement value in step S530, and notifies an error message for the abnormal stop state in step S540.

In the meantime, when there is no encoder connected to the motor in step S520, the mobile robot operation control apparatus 100 determines an abnormal stop state based on a predetermined error detection condition in step S532, and notifies an error message for the abnormal stop state in step S540.

Figure 6:
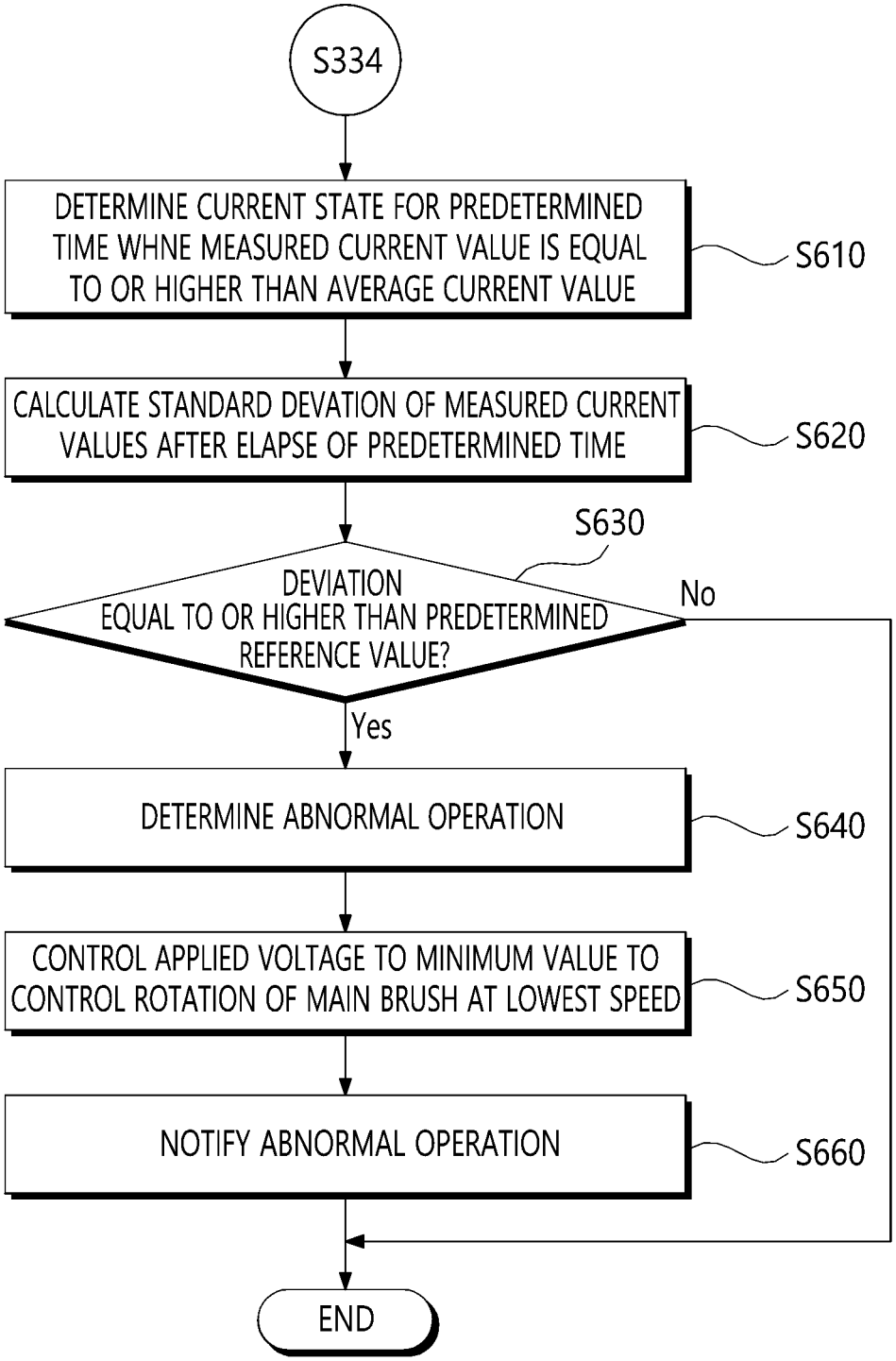

FIG. 6 illustrates a mobile robot operation control operation for safety management of a cleaning module in an abnormal jamming state.

When a measured current value is equal to or higher than an average current value, the mobile robot operation control apparatus 100 determines a current state for a predetermined time in step s610.

The mobile robot operation control apparatus 100 calculates a standard deviation of current values measured after elapse of a predetermined time in step S620.

When the calculated standard deviation is equal to or higher than a predetermined reference value in step S630, the mobile robot operation control apparatus 100 determines to be an abnormal operation (an abnormal jamming state) in step S640.

The mobile robot operation control apparatus 100 controls the applied voltage of the motor to a minimum value to control a rotation of the main brush at a lowest speed in step S650 and notifies the error message for the abnormal operation (abnormal jamming state) in step S660.

Even though in FIGS. 3 to 6, it is described that the steps are sequentially executed, the present disclosure is not necessarily limited thereto. In other words, the steps described in FIGS. 3 to 6 may be modified to be executed or one or more steps may be executed in parallel so that FIGS. 3 to 6 are not limited to a time-sequential order.

The mobile robot operation control method for safety management of a cleaning module according to the exemplary embodiment described in FIGS. 3 to 6 may be implemented by an application (or a program) and may be recorded in a terminal (or computer) readable recording media. The recording medium which has the application (or program) for implementing the mobile robot operation control method for safety management of a cleaning module according to the exemplary embodiment recorded therein and is readable by the terminal device (or a computer) includes all kinds of recording devices or media in which computing system readable data is stored.

Figure 7:
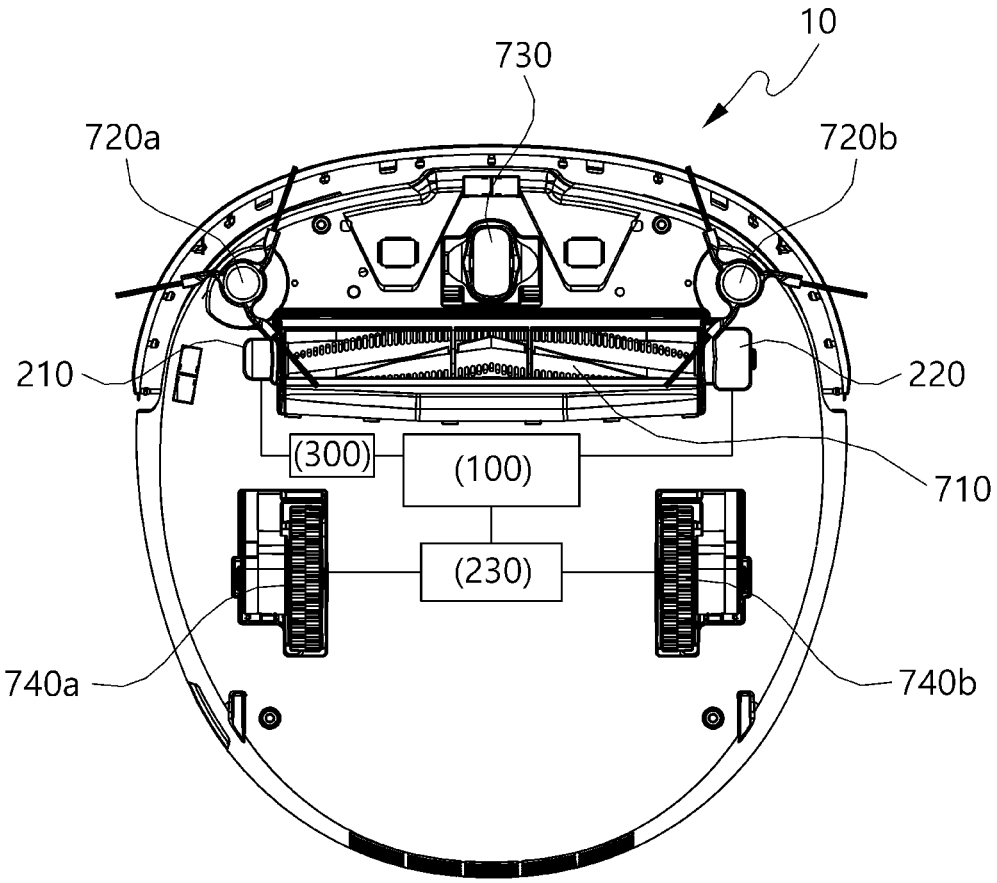
FIG. 7 is a view illustrating a mobile robot according to an exemplary embodiment of the present disclosure.

FIG. 7 is a view illustrating a mobile robot according to an exemplary embodiment of the present disclosure.

A mobile robot 10 according to the exemplary embodiment includes a main brush 710, a main brush motor 210 connected to the main motor 710, side brushes 720*a* and 520*b* which move dust and foreign materials on the floor to the main brush 710, a suction motor 220 for a cleaning operation to suck dust and foreign materials on the floor, and a movement motor 230 which drives the main wheels 740*a* and 540*b* and the auxiliary wheel 730 to move the mobile robot 10.

Further, the mobile robot 10 includes an encoder 300 connected to at least one motor 210, 220, and 230. Here, the encoder 300 refers to a sensor used to measure a rotation speed (an angular velocity) of the material to be transmitted.

Further, the mobile robot 10 includes a mobile robot operation control apparatus 100 which controls the main brush motor 210, the suction motor 220, and the movement motor 230 of the mobile robot 10 for safety management of the cleaning module.

Figure 8:
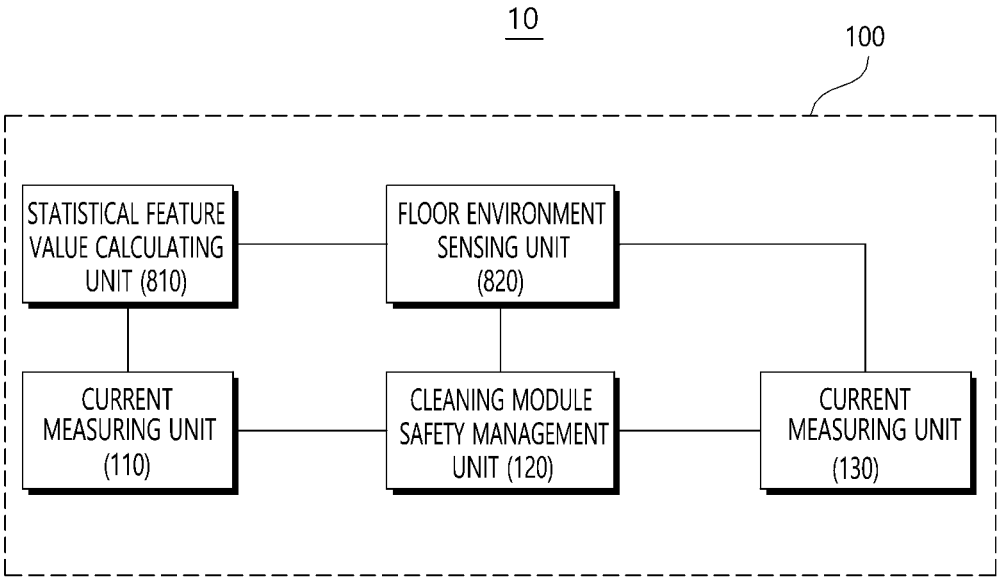
FIG. 8 is a block diagram schematically illustrating a mobile robot operation control apparatus for safety management of a cleaning module according to another exemplary embodiment of the present disclosure.

FIG. 8 is a block diagram schematically illustrating a mobile robot operation control apparatus for safety management of a cleaning module according to another exemplary embodiment of the present disclosure.

As compared with the mobile robot operation control apparatus 100 of FIG. 1, the mobile robot operation control apparatus 100 according to another exemplary embodiment of the present disclosure further performs a statistical value calculating operation and a floor environment sensing operation and performs the safety management of the cleaning module. Therefore, in FIG. 8, a statistical feature value calculating unit 810 which performs the statistical feature value calculating operation and a floor environment sensing unit 820 which performs a floor environment sensing operation which are added to the mobile robot operation control apparatus 100 will be described and a redundant description will be omitted.

The statistical feature value calculating unit 810 calculates an average of current values acquired for a predetermined time (buffer) to calculate a first statistical feature value and calculates a standard deviation of the current values acquired for a predetermined time (buffer) to calculate a second statistical feature value.

The statistical feature value calculating unit 810 further performs an operation of comparing a current statistical feature value according to a current operation routine of the mobile robot 10 and a past statistical feature value according to a past operation routine to predict an additional load applied to the main brush due to an additional factor independent from the floor environment. Thereafter, the statistical feature value calculating unit 810 calculates a statistical feature value by excluding an error according to the predicted additional load from the acquired current value or voltage value.

A current operation routine and a past operation routine for predicting an additional load refers to an operation routine generated as a camera image or an image, a map, and a coordinate generated by a Lidar sensor. Here, the current operation routine refers to a routine after starting the current cleaning and the past operation routine refers to a routine after starting the cleaning on the previous date.

In the mobile robot 10, a load may be further generated due to an additional factor independent from the floor environment. Here, the additional factor independent from the floor environment may include foreign materials (dust or hair) present on a rotary shaft of the main brush or other structure which interrupts the rotation of the main brush due to a mechanical error. For example, when the mobile robot 10 is in use, the main brush may be covered with dusts and even though the mobile robot travels on a hard floor along the same routine as the past operation routine, the load may be further generated due to the dusts on the main brush.

The floor environment sensing unit 820 calculates and sets a determination reference value for sensing a floor environment mode for a floor environment and compares at least one statistical feature value with a determination reference value to sense a floor environment mode for the floor environment.

Hereinafter, an operation of calculating a determination reference value in the floor environment sensing unit 820 will be described.

The floor environment sensing unit 820 calculates and sets a determination reference value to sense the floor environment mode for the floor environment. Here, the floor environment sensing unit 820 calculates a determination reference value using current values acquired for a predetermined time and when there is a previously calculated determination reference value, compares a newly calculated determination reference value and the previously calculated determination reference value to update the value.

The floor environment sensing unit 820 calculates an average of current values acquired for a predetermined time and when there is no previously set determination reference value, calculates and sets the average of the current values as a determination reference value.

In the meantime, the floor environment sensing unit 820 calculates an average of current values acquired for a predetermined time and when there is a previously calculated determination reference value, compares the average of the current value and the previously set determination reference value to adjust the determination reference value to an optimal determination reference value.

When the difference between the average of the current values acquired for a predetermined time and the previous determination reference value is equal to or higher than a predetermined threshold value, the floor environment sensing unit 820 adjusts the determination reference value to a newly calculated optimal determination reference value.

Hereinafter, an operation of sensing a floor environment based on the determination reference value calculated in the floor environment sensing unit 820 will be described.

The floor environment sensing unit 820 compares at least one statistical feature value with the determination reference value to sense a floor environment mode for the floor environment. Here, the floor environment mode may be one of the first floor environment mode and the second floor environment mode. Here, the first floor environment mode is a mode for a normal floor environment and refers to a hard floor type floor environment. Further, the second floor environment mode is a mode for a carpet floor environment and refers to a floor environment in which piles are present on a surface of a fabric.

Specifically, the floor environment sensing unit 820 compares the first statistical feature value and the second statistical feature value with the first determination reference value and the second determination value to sense one of the first floor environment mode and the second floor environment mode.

When the change of the floor environment mode is not sensed, the floor environment sensing unit 820 determines a state of the cleaning unit and selectively performs a cleaning module safety management operation (an operation of the cleaning module safety management unit 120) which determines a safety management control mode based on the determination result. Here, the change of the floor environment mode may be change from the first floor environment mode to the second floor environment mode or change from the second floor environment mode to the first floor environment mode.

The floor environment sensing unit 820 may selectively perform a cleaning module safety management operation by a predetermined operation setting or a manipulation input of the user.

When the change of the floor environment mode is sensed, the floor environment sensing unit 820 determines a state of the cleaning module and necessarily performs a cleaning module safety management operation to control a safety management control mode based on the determination result.

Hereinafter, operations of a first determining unit which performs first determination, a second determining unit which determines second determination, and a floor environment mode determining unit which determines a floor environment mode, included in the floor environment sensing unit, will be described.

The first determining unit (not illustrated) performs an operation of determining a current floor environment mode by comparing the statistical feature value and the determination reference value.

Specifically, the first determining unit compares the first statistical feature value and the first determination reference value and compares the second statistical feature value and the second determination value to determine a current floor environment mode.

If the first statistical feature value is equal to or higher than the first determination reference value and the second statistical feature value is equal to or higher than the second determination value, the first determining unit determines that the current floor environment is a second floor environment mode.

Further, if the first statistical feature value is lower than the first determination reference value and the second statistical feature value is lower than the second determination value, the first determining unit determines that the current floor environment is a first floor environment mode.

In the meantime, if a result of comparing the first statistical feature value and the first determination reference value is different from a result of comparing the second statistical feature value and the second determination value, the first determining unit determines that the current floor environment is a first floor environment mode which is a default setting mode.

The second determining unit (not illustrated) performs an additional determining operation for verifying a determination result for the current floor environment mode.

When the first determining unit determines that the current floor environment mode is the second floor environment mode, the second determining unit further determines the current floor environment mode based on a state maintaining time of the second floor environment mode.

When the second floor environment mode state is maintained for a predetermined maintaining time or longer, the second determining unit further determines that the current floor environment mode is a second floor environment mode.

In the meantime, when the first determining unit determines that the current floor environment mode is a first floor environment mode, the second determining unit may omit the additional determining operation.

The floor environment mode determining unit determines a final floor environment mode based on the determining result of the current floor environment mode.

When it is determined that the current floor environment mode is changed from the second floor environment mode to the first floor environment mode based on the determination result of the first determining unit, the floor environment mode determining unit determines the first floor environment mode as a final floor environment mode to allow the operation control unit 150 to generate an operation control signal of the mobile robot 10 corresponding to the first floor environment mode.

When it is determined that the current floor environment mode is the second floor environment mode based on the determination result of the first determining unit and the second determining unit further determines that the second floor environment mode is maintained for a predetermined time, the floor environment mode determining unit determines the second floor environment mode as a final floor environment mode to allow the operation control unit 150 to generate an operation control signal of the mobile robot 10 corresponding to the second floor environment mode. Here, the operation control signal may include a control signal indicting whether to perform a cleaning module safety management operation.

Figure 9:
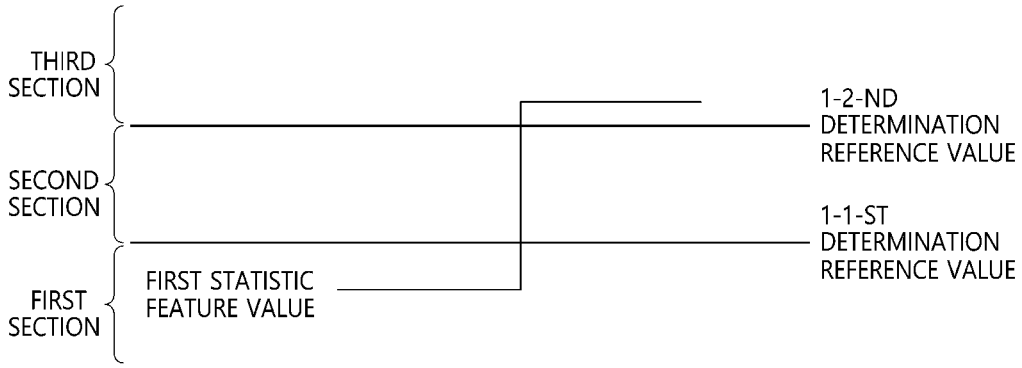
FIGS. 9 and 10 are views for explaining a floor environment sensing operation of a mobile robot operation control apparatus according to another exemplary embodiment of the present disclosure.
Figure 10:
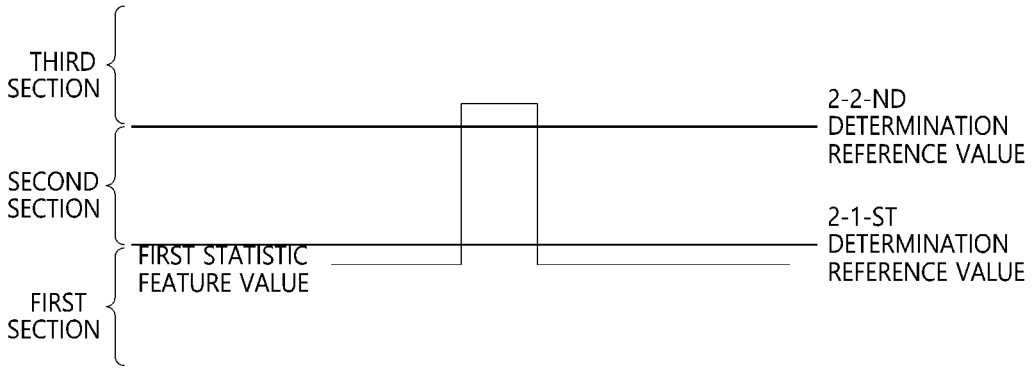

FIGS. 9 and 10 are views for explaining a floor environment sensing operation of a mobile robot operation control apparatus according to another exemplary embodiment of the present disclosure.

The mobile robot operation control apparatus 100 determines a state of the current floor environment by comparing a first determination reference set by a 1-1-st determination reference value and a 1-2-nd determination reference value and the first statistical feature value and comparing a second determination reference set by a 2-1-st determination reference value and a 2-2-nd determination reference value and the first statistical feature value.

FIG. 9 is an exemplary view for explaining an operation of comparing a first determination reference set by a 1-1-st determination reference value and a 1-2-nd determination reference value and the first statistical feature value and FIG. 10 is an exemplary view for explaining an operation of comparing a second determination reference set by a 2-1-st determination reference value and a 2-2-nd determination reference value and the second statistical feature value.

Referring to FIG. 9, the mobile robot operation control apparatus 100 may divide a first section, a second section, and a third section for the first determination reference using the 1-1-st determination reference value and the 1-2-nd determination reference value. Here, the 1-1-st determination reference value is desirably smaller than the 1-2-nd determination reference value.

In the first determination reference, the first section corresponds to the first floor environment mode (hard floor) section and the second section corresponds to a determination holding period. Further, in the first determination reference, the third section corresponds to the second floor environment mode (carpet floor environment).

The mobile robot operation control apparatus 100 may set the 1-1-st determination reference value and the 1-2-nd determination reference value using the first determination reference value. For example, the mobile robot operation control apparatus 100 may determine the 1-1-st determination reference value with the same value as the first determination reference value and add a predetermined threshold value to the first determination reference value to determine the 1-2-nd determination reference value.

Referring to FIG. 10, the mobile robot operation control apparatus 100 may divide a first section, a second section, and a third section for the second determination reference using the 2-1-st determination reference value and the 2-2-nd determination reference value. Here, the 2-1-st determination reference value is desirably smaller than the 2-2-nd determination reference value.

In the second determination reference, the first section corresponds to the section for maintain a floor environment and the second section corresponds to a determination holding section. Further, in the second determination reference, the third section corresponds to a section in which the floor environment changes.

The mobile robot operation control apparatus 100 may set the 2-1-st determination reference value and the 2-2-nd determination reference value using the first determination reference value. For example, the mobile robot operation control apparatus 100 may determine the 2-1-st determination reference value with the same value as the first determination reference value and add a predetermined threshold value to the second determination reference value to determine the 2-2-nd determination reference value.

The mobile robot operation control apparatus 100 finally determines the floor environment mode based on the first determination result section for the first determination reference using the 1-1-st determination reference value and the 1-2-nd determination reference value and the second determination result section for the second determination reference using the 2-1-st determination reference value and the 2-2-nd determination reference value.

When both the first determination result section and the second determination result section correspond to the third section, the mobile robot operation control apparatus 100 determines that the first floor environment mode is changed to the second floor environment mode and controls the cleaning operation of the mobile robot for the changed floor environment.

When both the first determination result section and the second determination result section correspond to the third section so that it is determined that the floor environment mode is changed, the mobile robot operation control apparatus 100 determines a state of the cleaning module and performs a cleaning module safety management operation (an operation of the cleaning module safety management unit 120) to determine the safety management control mode based on the determination result. Here, when the floor environment mode is changed, the mobile robot operation control apparatus 100 may performs an operation of determining only a safety state indicating whether to be the overload state.

When both the first determination result section corresponds to the third section and the second determination result section corresponds to the second section, the mobile robot operation control apparatus 100 holds the determination whether the floor environment is changed and when the corresponding section is maintained for a predetermined time, determines that it is a boundary area in which the floor environment is changed and controls the cleaning operation of the mobile robot for the boundary area.

When the first determination result section corresponds to the third section and the second determination result section correspond to the second section so that determination of change of the floor environment is held, the mobile robot operation control apparatus 100 determines a state of the cleaning module and performs a cleaning module safety management operation (an operation of the cleaning module safety management unit 120) to determine the safety management control mode based on the determination result. Here, when the determination whether the floor environment is changed is held, the mobile robot operation control apparatus may perform an operation of determining at least one safety state among an overload state, an abnormal stop state, and an abnormal jamming state.

In the meantime, when the first determination result section corresponds to the second section, the mobile robot operation control apparatus 100 reserves the determination for the floor environment change.

When a determination reserving state in which the first determination result section corresponds to the second section is continued for a predetermined time, the mobile robot operation control apparatus 100 determines whether the measured current value is increased due to an external factor, based on history data. Here, the history data may include a previously stored cleaning map (for example, a camera image or a map generated by a Lidar sensor) and flood environment mode information about at least one point set in the cleaning map.

When the first determination result section for the current floor environment for the same cleaning point is determined to be different from that in the past based on the history data, for example, the determination result section is the first section in the past, but is currently the second section, the mobile robot operation control apparatus 100 determines that the measured current value is increased due to external factors such as foreign substance jamming (for example, jamming of dusts, hair, and obstacle) to control the operation of the mobile robot to issue a message such as error notification.

Figure 11:
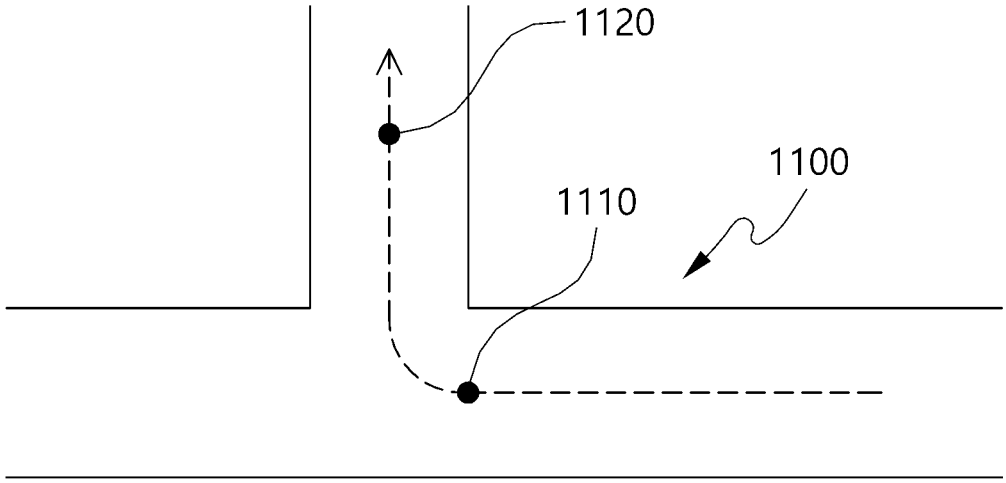
FIG. 11 is a view for explaining an operation of sensing a floor environment by correcting a measured current value based on a current offset in a mobile robot operation control apparatus according to another exemplary embodiment of the present disclosure.

FIG. 11 is a view for explaining an operation of sensing a floor environment by correcting a measured current value based on a current offset in a mobile robot operation control apparatus according to another exemplary embodiment of the present disclosure.

Referring to FIG. 11, the mobile robot operation control apparatus 100 calculates a current offset for an additional load which is applied to the main brush due to an independent addition factor from the floor environment and calculates a statistical feature value based on a corrected current value calculated by subtracting the current offset from the measured current value measured from the motor which is equipped in the mobile robot to operate. Here, even though it is described that the mobile robot operation control apparatus 100 calculates the current offset for the current value, if the measured value is a voltage value, a voltage offset is calculated to calculate a corrected voltage value.

The mobile robot operation control apparatus 100 sets an initial setting state to calculate the current offset. Here, the initialization setting state refers to a setting state in which the influence by the foreign materials or the failure is minimized and a new product state or a state after cleaning the inside of the mobile robot may be defined as the initialization setting state. However, it is not easy for the mobile robot operation control apparatus to constantly set the initialization setting state based on the inside cleaning state which is intermittently performed so that when the current value of the traveling mobile robot 10 is maintained below a predetermined reference (for example, the first determination reference value) or a distribution pattern of the current value is observed to be lower than the traveling of the last cleaning operation, it may be defined as the initialization setting state. Here, the initialization setting state may be a reference related to the current offset calculation to be described below.

Thereafter, the mobile robot operation control apparatus 100 may calculate the difference in the current values as a first current offset by comparing map additional information in a first anchor point 810 in the previously stored cleaning map. Here, the first current offset refers to a difference in the current values in the previous traveling and the current traveling of the first anchor point 810.

Further, the mobile robot operation control apparatus 100 may calculate the difference in the current values as a second current offset by comparing map additional information in a second anchor point 820 in the previously stored cleaning map. Here, the second current offset refers to a difference in the current values in the previous traveling and the current traveling of the second anchor point 820.

The first anchor point and the second anchor point are points extracted using the previously stored map information and refer to points corresponding to a position on a current routine similar to a position on the past moving routine. The cleaning map refers to a map generated based on information acquired from the camera image or the Lidar sensor and the map additional information refers to an environment sensor value (for example, a current value, a voltage value, and a statistical feature value) acquired at points which form the cleaning map.

The mobile robot operation control apparatus 100 may calculate any one value selected from the current offsets or an average value thereof as a final current offset.

The mobile robot operation control apparatus 100 may perform a determination operation of determining a floor environment mode by applying a corrected current value obtained by subtracting the final current offset from the measured current value acquired in the current routine.

In the meantime, the mobile robot operation control apparatus 100 may cumulatively store the current offsets at every predetermined period to calculate an accumulated current offset. Here, the predetermined period may be set to three weeks, one month, or two months.

When the accumulated current offsets obtained by accumulating the current offsets calculated for a predetermined time period for every anchor point exceeds a predetermined reference (for example, a predetermined threshold value), the mobile robot operation control apparatus 100 may determine that the mobile robot 10 is in a malfunction state.

When the accumulated current offset is identified to have a pattern which gradually increases (an increasing pattern below a predetermined increased amount), the mobile robot operation control apparatus 100 may predict that the failure is caused by the foreign materials which are consistently generated, such has dusts and hairs.

When the accumulated current offset is identified to have a pattern which sharply increases (an increasing pattern above a predetermined increased amount), the mobile robot operation control apparatus 100 may predict that the failure is caused by a predetermined external impact or an internal failure.

The mobile robot operation control apparatus 100 may estimate whether the failure is caused by the accumulated foreign materials or the impact by analyzing the change in the pattern of the accumulated current offset.

According to another exemplary embodiment of the present disclosure, the mobile robot operation control apparatus of the present disclosure may further include a learning unit (not illustrated) which extracts a floor environment feature value from a sensor value according to the floor environment. The learning unit may be implemented by an artificial neural network including an input layer, a hidden layer, and an output layer. Each layer includes a plurality of nodes and the nodes between adjacent layers may be implemented to be connected according to a determination weight which has been trained in advance by training data. Further, the mobile robot operation control apparatus may further include a pre-processing unit which pre-processes a sensor value. For example, the pre-processing unit receives a current signal according to an intensity of the current acquired in the unit of predetermined time intervals, samples the current signal at a predetermined sampling period, and converts the sampled value into a vector-matrix value to be processible in the learning unit.

Further, a current value in the acceleration/deceleration section, such as the section where the mobile robot changes a direction or the section where an obstacle is detected, observed under the condition of no load on the floor and a current value in the constant-velocity section that moves at a constant speed may have different patterns. In the present exemplary embodiment, a current value of the motor which is substantially observed in a no-load state is defined as a reference current value for every traveling mode. The floor environment feature value is desirably a feature value obtained with a reference subtracted current value obtained by subtracting a reference current value for every traveling mode from the observed current value as an input of the learning unit. By doing this, the deviation of the motor load according to the traveling mode is excluded so that the floor environment may be more precisely sensed. In the present exemplary embodiment, when the floor environment sensing unit determines the floor environment, the floor environment feature value obtained by the learning unit is further considered to determine the floor environment in which the moving robot is currently located.

It will be appreciated that various exemplary embodiments of the present disclosure have been described herein for purposes of illustration, and that various modifications and changes may be made by those skilled in the art without departing from the scope and spirit of the present invention. Accordingly, the exemplary embodiments of the present disclosure are not intended to limit but describe the technical spirit of the present invention and the scope of the technical spirit of the present invention is not restricted by the exemplary embodiments. The protective scope of the exemplary embodiment of the present invention should be construed based on the following claims, and all the technical concepts in the equivalent scope thereof should be construed as falling within the scope of the exemplary embodiment of the present invention.

What is claimed is:

1. A method for controlling an operation for safety management of a cleaning module in a mobile robot operation control apparatus, a mobile robot operation control method comprising:

a current measuring step of measuring a current value by sensing a current for a motor which is connected to a cleaning module to be driven;

a cleaning module safety management step of determining a state of the cleaning module based on the measured current value and determining a safety management control mode based on the state; and an operation control step of controlling an operation of a mobile robot based on the safety management control mode, wherein the cleaning module safety management step includes:

a current state determining step of determining a current state of the motor by comparing the measured current value with at least one reference current value of a first reference current value that refers to a maximum current value, a second reference current value that refers to a minimum current value, and an average current value that refers to an average or a standard deviation of current values;

a cleaning module state determining step of determining a safety state of the cleaning module based on the current state of the motor; and a safety management control mode determining step of determining the safety management control mode that corresponds to the safety state, wherein when the measured current value is between the first reference current value and the second reference current value and the current state is equal to or higher than the average current value measured for a predetermined time, in the cleaning module safety management step, it is determined that the safety state is a motor's abnormally jammed state and that the safety management control mode corresponds to the abnormal jamming state.

2. The mobile robot operation control method according to claim 1, wherein in the current measuring step, the current value in accordance with the rotating operation of a main brush is acquired from a motor connected to the main brush of the mobile robot to measure a current.

3. The mobile robot operation control method according to claim 1, wherein in the cleaning module state determining step, at least one safety state among an overload state, an abnormal stop state, and an abnormal jamming state is determined based on the current state of the motor.

4. The mobile robot operation control method according to claim 3, wherein in the safety management control mode determining step, a safety management control mode to perform at least one control operation of an operation of controlling an applied voltage of the motor and an operation of notifying an error message for an abnormal operation is determined based on the safety state.

5. The mobile robot operation control method according to claim 1, wherein when a measured current value is equal to higher than the first reference current value, in the cleaning module safety management step, it is determined that the safety state is a motor overloaded state and that the first safety management control mode corresponds to an overload state.

6. The mobile robot operation control method according to claim 1, wherein when the measured current value is lower than the second reference current value, in the cleaning module safety management step, it is determined that the safety state is a motor abnormally stopped state and that the second safety management control mode corresponds to an abnormal stop state.

7. The mobile robot operation control method according to claim 6, wherein when an encoder is connected to the motor, in the cleaning module safety management step, the safety state for the abnormal stop state is determined by comparing a rotation speed of the motor with an input voltage measured from the encoder.

8. The mobile robot operation control method according to claim 6, wherein when an encoder is not connected to the motor, in the cleaning module safety management step, if a voltage applied to the motor corresponds to a predetermined minimum applied voltage and a state in which a measured current of the motor exceeds a predetermined overcurrent reference value is maintained for a predetermined time, it is determined that the safety state is the abnormal stop state.

9. The mobile robot operation control method according to claim 1, wherein in the cleaning module safety management step, a standard deviation of the current values measured for a predetermined time is calculated and when the standard deviation is equal to or higher than the average current value, it is determined that the safety state is a motor's abnormally jammed state.

10. An apparatus for controlling an operation of a mobile robot for safety management of a cleaning module, the mobile robot operation control apparatus comprising:

a current measuring unit which measures a current value by sensing a current for a motor which is connected to a cleaning module to be driven;

a cleaning module safety management unit which determines a state of the cleaning module based on the measured current value and determines a safety management control mode based on the determination result; and an operation control unit which controls an operation of a mobile robot based on the safety management control mode;

wherein the cleaning module safety management unit includes:

a current state determining unit of determining a current state of the motor by comparing the measured current value with at least one reference current value of a first reference current value that refers to a maximum current value, a second reference current value that refers to a minimum current value, and an average current value that refers to an average or a standard deviation of current values;

a cleaning module state determining unit of determining a safety state of the cleaning module based on the current state of the motor; and a safety management control mode determining unit of determining the safety management control mode that corresponds to the safety state, wherein when the measured current value is between the first reference current value and the second reference current value and the current state is equal to or higher than the average current value measured for a predetermined time, in the cleaning module safety management unit, it is determined that the safety state is a motor's abnormally jammed state and that the safety management control mode corresponds to the abnormal jamming state.

11. The mobile robot operation control apparatus according to claim 10, wherein the current measuring unit acquires the current value in accordance with the rotating operation of a main brush from a motor connected to the main brush of the mobile robot to measure a current.

12. A mobile robot which performs a cleaning operation based on safety management of a cleaning module, comprising:

at least two main wheels;

a movement motor which generates a driving force to rotate the main wheels;

a main brush to which at least one blade is coupled;

a main brush motor which rotates the main brush; and a mobile robot operation control apparatus which measures a current value by sensing a current from the main brush motor, determines a state of the cleaning module based on the measured current value and determines a safety management control mode based on the state, and controls an operation of a mobile robot based on the safety management control mode;

wherein the mobile robot operation control apparatus includes:

a current state determining unit of determining a current state of the motor by comparing the measured current value with at least one reference current value of a first reference current value that refers to a maximum current value, a second reference current value that refers to a minimum current value, and an average current value that refers to an average or a standard deviation of current values;

a cleaning module state determining unit of determining a safety state of the cleaning module based on the current state of the motor; and a safety management control mode determining unit of determining the safety management control mode that corresponds to the safety state, wherein when the measured current value is between the first reference current value and the second reference current value and the current state is equal to or higher than the average current value measured for a predetermined time, in the mobile robot operation control apparatus, it is determined that the safety state is a motor's abnormally jammed state and that the safety management control mode corresponds to the abnormal jamming state.

* * * * *